United States Patent [19]

Minnich

[11] 4,245,951

[45] Jan. 20, 1981

[54] POWER TURBINE SUPPORT

[75] Inventor: John B. Minnich, Indianapolis, Ind.

[73] Assignee: General Motors Corporation, Detroit, Mich.

[21] Appl. No.: 900,112

[22] Filed: Apr. 26, 1978

[51] Int. Cl.[3] ..... F01D 25/24

[52] U.S. Cl. ..... 415/139; 415/170 R

[58] Field of Search ..... 415/136, 137, 138, 139, 415/116, 170 R; 60/39.08, 39.32

[56] References Cited

U.S. PATENT DOCUMENTS

| | | | |
|---|---|---|---|
| 2,447,942 | 8/1948 | Imbert et al. . | |
| 2,505,217 | 4/1950 | Smith et al. . | |
| 2,807,934 | 10/1957 | Purvis et al. . | |
| 2,836,393 | 5/1958 | Payne et al. | 415/115 |
| 3,067,981 | 12/1962 | Swatman . | |
| 3,084,849 | 4/1963 | Dennison | 415/115 |
| 3,421,686 | 1/1969 | Coplin et al. . | |
| 3,814,539 | 6/1974 | Klompas | 415/115 |
| 3,877,762 | 4/1975 | Dennison . | |

*Primary Examiner*—Robert E. Garrett

*Attorney, Agent, or Firm*—J. C. Evans

[57] ABSTRACT

A gas turbine engine power turbine support structural nozzle includes a nozzle ring with an annular outer shroud and an inboard blade platform having a plurality of cast nozzle vanes therebetween located at circumferentially spaced points for directing motive fluids through the turbine; the support includes bearing oil and air coolant annuli. The outer annular engine case has mounting holes therein that receive a plurality of circumferentially spaced radially directed mounting trunnions through which both oil and coolant are supplied from external of the case to the annuli and the trunnions are coupled to the outer case by means that accurately cross key locate the nozzle ring within the engine case for free radial expansion relative thereto and wherein an annular index flange of the nozzle platform slidably supports a bearing cage engaged by dowel pins to accurately cross key locate and thermally accommodate the bearing cage with respect to the nozzle ring to maintain it accurately centered with respect to the turbine case during thermal excursions of the nozzle ring with respect thereto.

4 Claims, 3 Drawing Figures

POWER TURBINE SUPPORT

Figure 1:
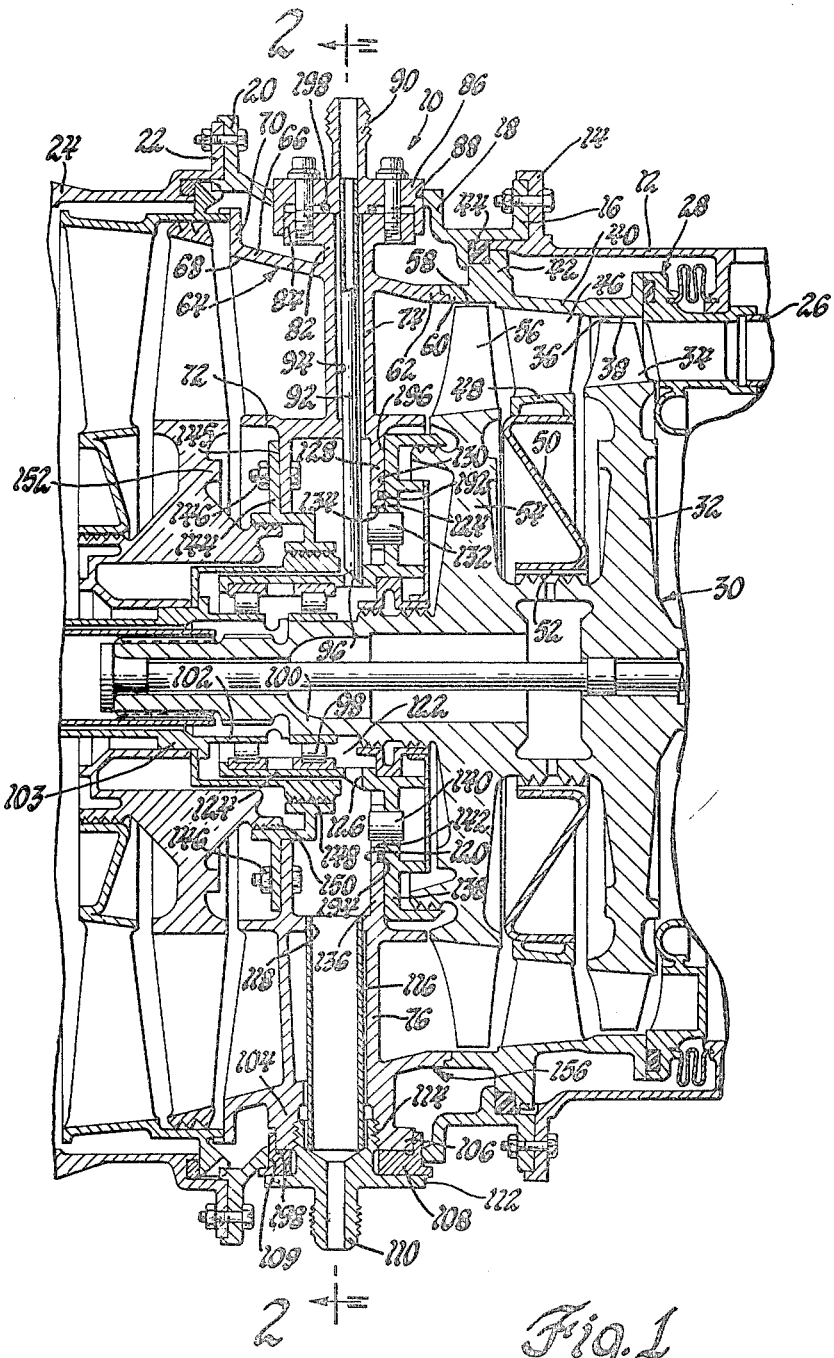

This invention relates to gas turbine engines and more particularly to gas turbine engines having power turbine support and nozzle assemblies therein.

Aircraft gas turbine engines are known which include a multi-stage gas producer rotor assembly having shaft extensions on either end thereof that are rotatably supported in bearing assemblies. Such bearing assemblies are desirably maintained in a centered relationship with respect to an outer case of the gas turbine engine. Moreover, at least one of such bearing assemblies is supported by a nozzle ring component of the gas turbine engine.

In order to improve durability in such arrangements, it is desirable to include means associated with the nozzle ring to accurately cross key locate it within an outer turbine case while including means for supporting the ring for thermal growth with respect to the outer case without affecting the centering of the nozzle ring and to further include means for radially supporting a bearing on the nozzle ring and cross key located it with respect to the nozzle ring so that it will be maintained accurately centered with respect to the case under all conditions of thermal operation.

Heretofore, bearings have been supported by means for allowing thermal expansion of a bearing support with respect to an outer case. For example, in U.S. Pat. No. 3,877,762, issued Jan. 14, 1969, to Coplin et al, separate struts are provided between an outer casing ring and an inner support ring for the bearing and wherein each of the struts are pivotally connected to allow for relative expansion between the joined parts. However, the arrangement makes no provision for locating a turbine nozzle assembly in radial surrounding relationship to an internal bearing cage with means to support a turbine rotor with respect to a nozzle assembly wherein it is important to provide accurate centering of a rotor bearing assembly and the nozzle assembly with respect to an outer case member.

Additional prior art includes U.S. Pat. No. 3,067,981, issued Dec. 11, 1962, to Swatman, which discloses an arrangement for resiliently supporting a turbine nozzle ring with respect to an outer case and an internally located bearing assembly. This arrangement, however, requires a plurality of separate radially sliding, internal pin components and a specially designed turbine shroud assembly having specially configured thermal expansible segments thereon to accommodate thermal expansion in the ring during operation of the device.

Accordingly, an object of the present invention is to provide a compactly arranged, substantially radially stacked, power turbine support structural nozzle assembly that has a turbine rotor bearing support and nozzle ring components maintained centered throughout a wide range of thermal operating conditions of the gas turbine engine and wherein the nozzle ring has a first plurality of trunnion bosses on an outer shroud component thereof and a flange on an inboard located blade platform thereof to accurately cross key locate both the nozzle ring and bearing assembly located immediately radially inwardly of the nozzle ring to assure axial length compactness.

Yet another object of the present invention is to provide an improved compactly arranged turbine support structural nozzle assembly including an outboard support for radially slidably supporting the nozzle assembly on an outer case and an inboard flange for slidably supporting a bearing assembly with respect to a nozzle ring and for maintaining it centered with respect to the outer case during gas turbine engine operation and wherein external support bosses for the nozzle ring serve to define a path to bearing oil and coolant annuli in the support structural nozzle assembly for oil and coolant inflow to bearing and seal assemblies.

Yet another object of the present invention is to provide a gas turbine nozzle and rotor support assembly as set forth in the preceding object including means for directing coolant and lubricating oil into seal and bearing assemblies through a first set of external support bosses and for withdrawing oil from the internally located bearing and seal assemblies through a second set of support bosses located diametrically opposite the first set.

Further objects and advantages of the present invention will be apparent from the following description, reference being had to the accompanying drawings wherein a preferred embodiment of the present invention is clearly shown.

Figure 2:
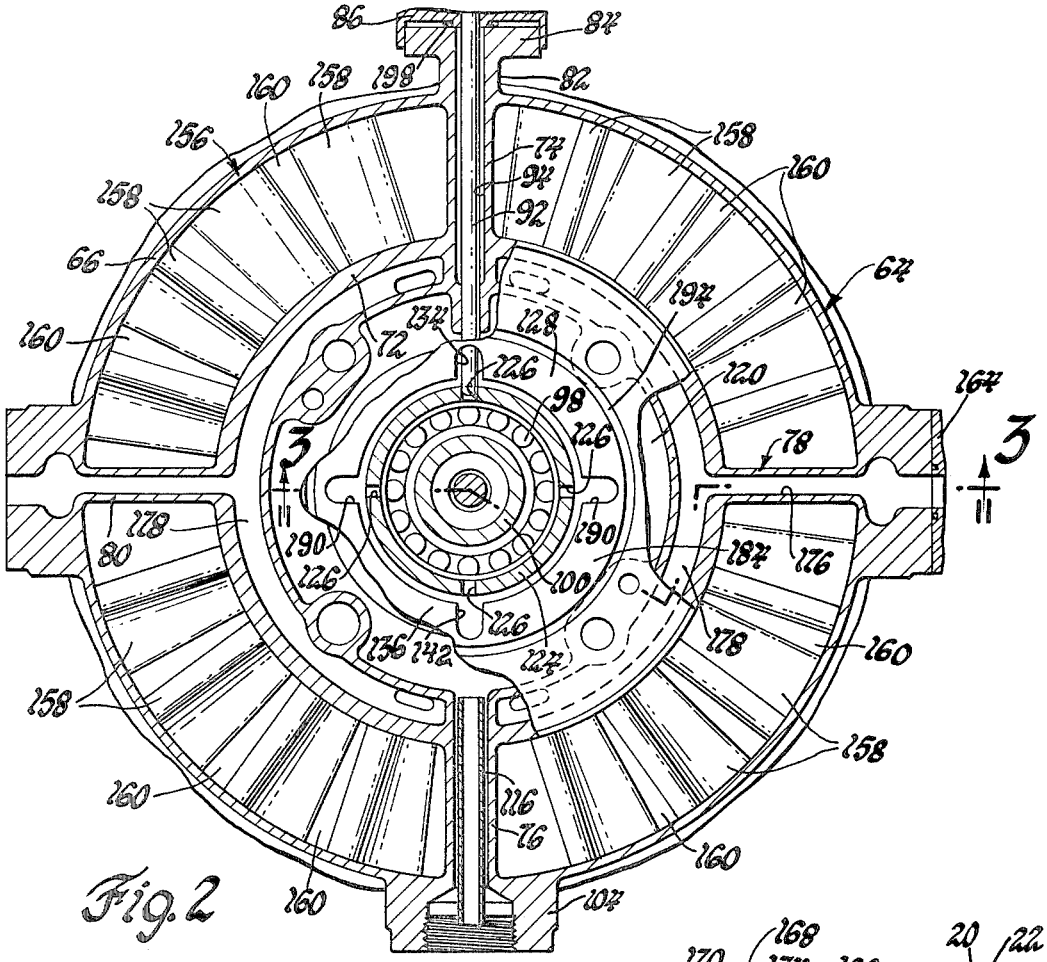
Figure 3:
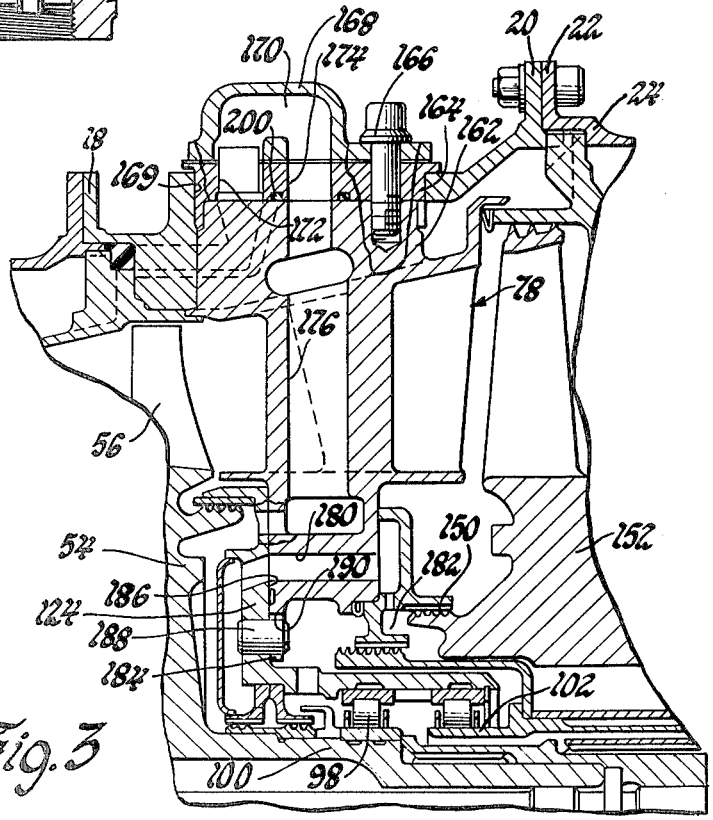

FIG. 1 is a longitudinal cross sectional view of a turbine section of a gas turbine engine including a power turbine support structural nozzle and lubrication supply in the present invention;

FIG. 2 is a vertical cross sectional view taken along the line 2—2 of FIG. 1 looking in the direction of the arrows with parts of an outer case broken away and with parts of an internal shaft bearing in to show a bearing housing carried by the support structural nozzle; and FIG. 3 is a cross sectional view taken along the line 3—3 of FIG. 2 looking in the direction of the arrows to highlight the flow paths for an air coolant supply network formed in association with the power turbine support structural nozzle of FIG. 1.

Referring now to the drawings in FIG. 1, a turbine section 10 of a gas turbine engine is illustrated. It includes an upstream outer case 12 having an external flange 14 connected to a forward or upstream flange 16 of a power turbine case 18 including an aft or downstream flange 20 thereon coupled to an external flange 22 of an engine case 24 that receives exhaust from turbine stages within the cases 12, 18 and 24.

In accordance with certain principles of the present invention, it is recognized that gas turbine engines are characterized by a range of thermal operating conditions where component parts thereof are subject to thermal expansion which must be accommodated within the confines of cooler operating external power turbine case components such as those shown at 12, 18, and 24.

More particularly, in the illustrated arrangement combustion products are directed through a duct transition member 26 to a first stage nozzle ring 28 located upstream of a two stage gas producer turbine rotor assembly 30. The rotor assembly 30 more particularly includes a first stage wheel 32 having a plurality of radially outwardly directed turbine vanes 34 thereon each having a radially outwardly located tip 36 arranged in closely spaced relationship to the inner surface 38 of an outer shroud member 40 having a radially outwardly directed annular flange 42 thereon supportingly connected between the outer case 12 and the power case 18 and sealed with respect thereto by an O-ring seal 44.

The first stage shroud 40 serves as a stator segment in the gas turbine section 10. It supports a second stage nozzle ring 46 having an annular base 48 secured to a Z-shaped seal brace 50 that supportingly locates an annular seal assembly 52 to prevent gas bypass between the first stage wheel 32 of the rotor 30 and a second stage wheel 54 thereon. The second stage wheel 54 includes a plurality of turbine vanes 56 thereon each having a radial tip 58 located in spaced relationship to an annular axial extension 60 on the shroud 40 which is located in overlapping relationship to an annular lead lip 62 on a power turbine support structural nozzle 64 constructed in accordance with the present invention.

More particularly, the support structural nozzle 64 includes an outer shroud 66 thereon with a radially downstream divergent inner surface 68 and with a radially outwardly directed flange 70 on the aft end thereof. The power turbine support structural nozzle 64 further includes an annular blade platform 72 integrally joined to the outer shroud 66 by a first pair of struts 74, 76 located in alignment with one another at diametrically opposite points on the nozzle 64. Additionally, a second pair of struts 78, 80 are located along an axis perpendicular to that defined by the struts 74, 76 to integrally join the blade platform 72 with the outer shroud 66.

In accordance with certain principles of the present invention, the struts 74 through 80 are located with respect to the power turbine case 18 in cross centered relationship thereto to provide for a limited amount of radial thermal expansion of the support structural nozzle 64 with respect to the cooler operating outer power turbine case 18.

More particularly, strut 74 includes a support trunnion boss 82. Trunnion boss 82 has an annular flange 84 thereon secured to a fitting 86 that is slidably supported within an opening 88 in outer turbine case 18 for radial expansion with respect thereto.

More particularly, the fitting 86 includes an inlet oil supply tip 90 extending radially outwardly of the fitting 86 to receive cooling and lubrication oil for flow into an oil nozzle 92 that extends through a radially inwardly directed hole 94 in the strut 74 to supply oil to an oblique outlet port 96 arranged in alignment with a pair of axially spaced roller bearing assemblies 98, 100 that support a shaft extension 100 on the rotor assembly 30 and a shaft segment 102 on a second shaft assembly 103 for directing power from the gas turbine section 10.

The strut 76 includes a trunnion boss 104 having a flange 106 thereon supportingly received within a fitting 108 that is supportingly received for radial expansion within an opening 109 in the power turbine case 18 at a point diametrically opposite to the opening 88 therein. The fitting 108 has an oil outlet tip 110 thereon formed inwardly of a hexagonally configured nut 112 including an externally threaded extension 114 thereon threadably received within the flange 106 to support one end of an oval, oil collection tube 116 having the opposite end thereof seated against a shoulder 118 located internally of the strut 76 in overlying relationship to an oil annulus 120 in nozzle 64. Annulus 120 is in communication with the interior 122 of a bearing assembly cage 124 through a plurality of ports 126 therethrough.

Another feature of the present invention is that the bearing assembly cage 124 is located immediately radially inboard of the support structural nozzle 64 so as to locate the bearing assemblies 98, 100 within a reduced axial extent to support opposite ends of a gas producer turbine shaft 100 and power turbine shaft 103 of the gas turbine assembly. The support structural nozzle member 64 is further configured to support the bearing cage 124 in a compact axial configuration and to maintain it centered with respect to the cooler operating power turbine case 18 throughout all phases of gas turbine operation. More particularly, to accomplish this objective, the strut 74 includes a radially inwardly located annular index flange 128 that slidably supports one side 130 of the bearing cage 124 as best seen in FIG. 1. The bearing cage 124 supports a dowel pin 132 that extends into side slot 134 in the flange 128 to cross key locate the bearing cage 124 with respect to the support structural nozzle 64. Likewise, the strut 76 aligns with an arcuate segment 136 of flange 128 thereon that supportingly receives a wall segment 138 in the bearing cage 124 as shown in FIG. 1 to slidably support the bearing cage 124 with respect to this segment of the support structural nozzle 64. A dowel pin 140 is supported in the bearing cage 124 across from pin 132 to extend into interlocked relationship with a slot 142 in the side of the arcuate wall segment 136 as best shown in FIGS. 1 and 2 to further cross key locate the bearing cage 124 with respect to the support structural nozzle 64.

A seal support 144 is secured to the inboard side 145 of nozzle 64 by axially directed screws 146, two of which are shown in FIG. 1.

The seal support 144 is located in overlying relationship to a first annular internal shaft seal 148 and a second annular seal 150 carried on an upstream extension on a third stage rotor 152 to prevent gas bypass from the upstream stages around the support structural nozzle 64.

More particularly, the nozzle 64 includes a third stage nozzle ring 156 comprised of the annular blade platform 72 and a plurality of integrally formed, cast nozzle vanes 158 extending radially therefrom as shown in FIG. 2 to be joined to the outer shroud 66. The nozzle vanes 158 define gas passages 160 therebetween to receive motive fluid from the second stage wheel 54.

During high temperature gas turbine engine operation motive fluid passing through the gas passages 160 will heat the outer shroud 66 and blade platform 72 to produce radial expansion with respect to both outer case 18 and the bearing cage 124. The struts 74, 76 are both configured to accommodate such radial expansion and to maintain the bearing cage 124 centered with respect to the outer power turbine case 18.

Likewise, the struts 78, 80 are configured to further provide for free radial thermal expansion of the support structural nozzle 64 during such high temperature operation.

More specifically, the strut 78 includes an outer trunnion boss 162 thereon supported in a cooling air fitting 164 that is fastened by means of screws 166 to the trunnion 162 and to an air cover 168. Fitting 164 is supported in opening 169 in case 18 for radial sliding movement therebetween. The air cover 168 includes a crossover passage 170 from a cooling air inlet port 172 to a cooling air supply port 174 leading to a coolant passage 176 through the strut 78 from whence cooling air flows back to a return passage in the form of an internal annulus 178 in nozzle 64. Annulus 178 is communicated with a cooling passage 180 that directs coolant air to a space 182 between the seal assemblies 148, 150 to direct cooling air flow thereacross during gas turbine engine operation.

The aforedescribed configuration enables the outer shroud 66 to freely expand with respect to the outer turbine case 18 in the vicinity of the crossover passage 170.

The strut 78 includes an arcuate segment 184 of flange 128 that slidably supports wall segment 186 of the bearing cage 124. A dowel pin 188 is carried by the cage wall segment 186 and is extended axially into a slot 190 on the arcuate segment 184 to cross index the bearing cage 124 with respect to the support structural nozzle 64 at this vicinity of the assembly.

The support structural nozzle 64 includes an annular O-ring seal 192 and an arcuate groove 194 thereon that is located in sealed engagement with the side 130 of the bearing cage 124 to seal against oil leakage from the bearing cage 124. Likewise, suitable O-ring seals 198 and 200 are located between the nozzle 64 and the oil and air fittings to seal therebetween.

In addition to providing freedom of radial expansion and centering of the bearing cage with respect to the outer case, the aforesaid arrangement enables the part to be readily stacked along a substantially radial axis through the support members, the bearing cage and the seal support plate. The parts as previously noted when stacked together, are located within a limited axial extent of the power turbine assembly.

The support structural nozzle 64 is thus characterized by having a plurality of radially outwardly directed peripheral trunnions thereon all of which are radially spaced from the case 18 and a single annular radially inwardly located flange that slidably receives the bearing cage. A plurality of fittings lock the nozzle 64 to the case 18 for free expansion and a plurality of dowels lock the bearing cage in a cross keyed relationship to the nozzle but yet permits a free expansion of the support member with respect to the bearing cage so that it will be maintained centered with respect to the outer case 18. Maintenance of such radial centering assures desired clearance between the tips of the rotating blades and the annular surrounding static shroud components of the multi-stage turbine section of the present invention. This is accomplished throughout a substantial differential operating temperature of the gas flow through the gas passages 160 in the nozzle vanes 158 that are formed as an integral part of the single power turbine support structural nozzle 64.

While the embodiments of the present invention, as herein disclosed, constitute a preferred form, it is to be understood that other forms might be adopted.

The embodiments of the invention in which an exclusive property or privilege is claimed are defined as follows:

1. A power turbine support and structural nozzle assembly comprising a rotor, a turbine nozzle ring with an annular outer shroud and an inboard annular blade platform, a plurality of nozzle vanes connected between said shroud and said platform at circumferentially spaced points therearound for flow of motive fluid, a turbine bearing cage located radially inwardly of said platform including means thereon to rotatably support the rotor, an outer annular engine case having mounting holes therein, a plurality of circumferentially spaced, radially directed trunnion bosses on said outer shroud radially inwardly spaced from said case and aligned with said holes, and connection means to couple said trunnion bosses to said case for accurately cross-key locating said nozzle ring within said engine case while permitting free radial expansion of said nozzle ring with respect to said engine case, and an index flange on said platform directed radially inwardly thereof, and means on said bearing cage slidably supported on said index flange to accurately cross-key locate and to freely radially support said bearing cage with respect to said nozzle ring to maintain said bearing cage accurately centered with respect to said case during thermal expansion of said nozzle ring with respect thereto.

2. A power turbine support and structural nozzle assembly comprising a rotor, a turbine nozzle ring with an annular outer shroud and an inboard annular blade platform, a plurality of nozzle vanes connected between said shroud and said platform at circumferentially spaced points therearound for flow of motive fluid, a turbine bearing cage located radially inwardly of said platform including means thereon to rotatably support the rotor, an outer annular engine case having mounting holes therein, a plurality of circumferentially spaced, radially directed trunnion bosses on said outer shroud radially inwardly spaced from said case and aligned with said holes, and connection means to couple said trunnion bosses to said case for accurately cross-key locating said nozzle ring within said engine case while permitting free radial expansion of said nozzle ring with respect to said engine case, and an index flange on said platform directed radially inwardly thereof, and means on said bearing cage slidably supported on said index flange to accurately cross-key locate and to freely radially support said bearing cage with respect to said nozzle ring to maintain said bearing cage accurately centered with respect to said case during thermal expansion of said nozzle ring with respect thereto, said connection means including sleeves with a length greater than the depth of said outer case at said case hole to define an expansion bearing surface, means for connecting the inboard end of said sleeves to said trunnion bosses to bridge the gap between said case and said structural nozzle.

3. A power turbine support and structural nozzle assembly comprising a rotor, a turbine nozzle ring with an annular outer shroud and an inboard annular blade platform, a plurality of nozzle vanes connected between said shroud and said platform at circumferentially spaced points therearound for flow of motive fluid, a turbine bearing cage located radially inwardly of said platform including means thereon to rotatably support the rotor, an outer annular engine case having mounting holes therein, a plurality of circumferentially spaced, radially directed trunnion bosses on said outer shroud radially inwardly spaced from said case and aligned with said holes, and connection means to couple said trunnion bosses to said case for accurately cross-key locating said nozzle ring within said engine case while permitting free radial expansion of said nozzle ring with respect to said engine case, and an index flange on said platform directed radially inwardly thereof, and means on said bearing cage slidably supported on said index flange to accurately cross-key locate and to freely radially support said bearing cage with respect to said nozzle ring to maintain said bearing cage accurately centered with respect to said case during thermal expansion of said nozzle ring with respect thereto, a pair of hollow struts aligned with said trunnion bosses and extending from said outer shroud through said blade platform, said connection means including an oil inlet fitting, an oil nozzle extending through one of said pair of hollow struts to direct oil to said bearing cage, and an oil return duct in the other of said pair of hollow struts to return oil from said cage.

4. A power turbine support and structural nozzle assembly comprising a rotor, a turbine nozzle ring with an annular outer shroud and an inboard annular blade platform, a plurality of nozzle vanes connected between said shroud and said platform at circumferentially spaced points therearound for flow of motive fluid, a turbine bearing cage located radially inwardly of said platform including means thereon to rotatably support the rotor, seal means on said cage to prevent bypass of motive fluid from upstream of said nozzle ring to a point downstream thereof, an outer annular engine case having mounting holes therein, a plurality of circumferentially spaced, radially directed trunnion bosses on said outer shroud radially inwardly spaced from said case and aligned with said holes, and connection means to couple said trunnion bosses to said case for accurately cross key locating said nozzle ring within said engine case while permitting free radial expansion of said nozzle ring with respect to said engine case, and an index flange on said platform directed radially inwardly thereof, and means on said bearing cage slidably supported on said index flange to accurately cross-key locate and to freely radially support said bearing cage with respect to said nozzle ring to maintain said bearing cage accurately centered with respect to said case during thermal expansion of said nozzle ring with respect thereto, said structural nozzle assembly further including a plurality of circumferentially spaced hollow struts extending radially between said outer shroud and said blade platform means including a first pair of said struts defining an oil supply and return for said bearing cage, and means including a second pair of said struts defining a fluid supply and return path for coolant flow to both said bearing cage and said seal means.

* * * * *